US006293109B1

(12) United States Patent
Miyamoto et al.

(10) Patent No.: US 6,293,109 B1
(45) Date of Patent: Sep. 25, 2001

(54) PULSE PIPE REFRIGERATING MACHINE AND CRYOPUMP USING THE REFRIGERATING MACHINE

(75) Inventors: Atsushi Miyamoto; Yasuhiro Kakimi; Shingo Kunitani; Daisuke Ito, all of Osaka (JP)

(73) Assignee: Daido Hoxan Inc., Sapporo (JP)

( * ) Notice: Subject to any disclaimer, the term of this patent is extended or adjusted under 35 U.S.C. 154(b) by 0 days.

(21) Appl. No.: 09/485,491

(22) PCT Filed: Jun. 9, 1999

(86) PCT No.: PCT/JP99/03094

§ 371 Date: Feb. 11, 2000

§ 102(e) Date: Feb. 11, 2000

(87) PCT Pub. No.: WO99/64797

PCT Pub. Date: Dec. 16, 1999

(30) Foreign Application Priority Data

Jun. 12, 1998 (JP) ..... 10-165596

(51) Int. Cl.[7] ..... F25B 9/00; B01D 8/00

(52) U.S. Cl. ..... 62/6; 62/55.5

(58) Field of Search ..... 62/6, 55.5

(56) References Cited

U.S. PATENT DOCUMENTS 3,892,273 * 7/1975 Nelson ..... 165/105
5,181,383 * 1/1993 Goto et al. ..... 62/6
5,269,147 * 12/1993 Ishizaki et al. ..... 62/6
5,443,548 * 8/1995 Saho et al. ..... 62/51.1

FOREIGN PATENT DOCUMENTS

03286967 * 12/1991 (JP) .
08054151 * 2/1996 (JP) .

* cited by examiner

*Primary Examiner*—William Doerrler
(74) *Attorney, Agent, or Firm*—Armstrong, Westerman, Hattori, McLeland & Naughton, LLP

(57) ABSTRACT

A pulse tube refrigerator which enables holding a cooling temperature without the use of a heater and the like. The pulse tube refrigerator employs a working gas which has a liquefying temperature within the range of an operating temperature of the pulse tube refrigerator.

5 Claims, 2 Drawing Sheets

PULSE PIPE REFRIGERATING MACHINE AND CRYOPUMP USING THE REFRIGERATING MACHINE

TECHNICAL FIELD

The present invention relates to a reliable pulse tube refrigerator which can hold a cooling temperature without the use of an additional mechanism such as a heater, and a cryopump using the same.

BACKGROUND ARTS

A cryopump generally produces a high vacuum by adsorbing a gas molecule to an adsorption panel installed on a coldhead of a refrigerator. It is required in the cryopump that a cooling temperature for the adsorption panel is held in a designated range while the adsorption panel adsorbs a gas molecule.

For example, a cryopump exclusive for water requires the cooling temperature for the adsorption panel 3 (FIG. 1) to be held in the range of about 110K. FIG. 1 is a general view of the cryopump exclusive for water. In FIG. 1, there are shown a refrigerator 1 which may be a GM (Gifford-McMahon) refrigerator, a coldhead 2, an adsorption panel 3 installed on the coldhead 2, a vacuum space 4 in use of the cryopump and a fixture flange 5.

At present, a GM refrigerator is mainly employed to cool the cryopump, wherein helium gas (single gas) is used as an operating gas. During a normal operation the temperature of the adsorption panel 3 decreases to not greater than 110K (in some cases the temperature decreases to as low as 30 to 40K), and thus deviating from an original purpose to eliminate only water by freezing, other gas components may be frozen. To obviate such a problem, the cryopump exclusive for water is provided with a heater and a thermometer (both are not shown in the figure) on the coldhead 2 for holding a temperature. The adsorption panel 3 can hold its temperature by controlling the temperature of the heater.

However, the conventional cryopump has a heater wiring led out of the vacuum space 4 into the atmosphere, requiring a complicated seal with a high risk of leakage. Further, a temperature controller is necessary in order to follow heat load changes (for example, when water is excessively attached to the adsorption panel 3 or when the vacuum degree is lowered, the temperature of the adsorption panel 3 is increased, necessitating control the temperature control of the heater). Therefore, a complicated mechanism is required, resulting in a cost increase.

In Japanese Patent Publication TOKKAIHEI 6-73542, a cryopump is disclosed which includes, as temperature control means for the adsorption panel 3, a heat exchanger, a connector connecting the heat exchanger to the adsorption panel 3, transport means for transporting a cooling medium such as helium gas to the heat exchanger, means for regulating a flow rate of the cooling medium and the like. However, the above-disclosed cyropump also requires a complicated mechanism with a cost increase.

In view of the foregoing, it is an object of the present invention to provide a pulse tube refrigerator which can hold a cooling temperature without the use of a heater and the like and a cryopump using the pulse tube refrigerator.

DISCLOSURE OF THE INVENTION

In accordance with a first aspect of the present invention, there is provided a pulse tube refrigerator employing a working gas which has a liquefying temperature within the range of an operating temperature of the pulse tube refrigerator. In accordance with a second aspect of the present invention, there is provided a cryopump using the above pulse tube refrigerator.

The pulse tube refrigerator of the present invention employs the working gas which has a liquefying temperature within the range of the operating temperature of the pulse tube refrigerator. Therefore, during the operation of the pulse tube refrigerator, the working gas is not cooled lower than the range of the operating temperature of the pulse tube refrigerator, which is substantially equal to the liquefying temperature, and the pulse tube refrigerator keeps its temperature generally constant within the range of the operating temperature thereof. Moreover, after the working gas is cooled to the liquefying temperature, even an external heat load almost causes no temperature change of the coldhead. However, in the case that the heat intake is further increased by the external heat load, the temperature of the coldhead is rapidly increased. Accordingly, it is necessary that a designated temperature of the working gas be set in a temperature range wherein the coldhead causes almost no change in temperature by the external heat load. The temperature range can be adjusted to some extent by use of a mixture of several kinds of gas as a working gas.

More specifically, in operation of the pulse tube refrigerator employing a gas other than helium (for example nitrogen gas), as a working gas, which has a higher liquefying temperature, the working gas is liquefied at a low temperature side of the pulse tube refrigerator. However, in the pulse tube refrigerator, the working gas is compressed and expanded, or moved between the low and high temperature sides, so that the liquefied working gas may be in contact with a portion with a temperature not less than its boiling point, or so that its boiling point may be reduced due to expansion on pressure reduction. Therefore, the liquefied working gas becomes gaseous again without solidifying. Thus, the working gas is repeatedly liquefied and gasified in one cycle, so that the pulse tube refrigerator can operate without clogging a flow path by the working gas. The coldhead of the pulse tube refrigerator holds a temperature of about the liquefying temperature (boiling point) of the working gas. Where the heat load to the coldhead increases (or decreases), the volume of the liquefied gas in one cycle is decreased (or increased). Nevertheless, the coldhead holds a temperature of about the liquefying temperature of the working gas. Even if the heat intake is further increased, the coldhead holds a temperature of about the liquefying temperature of the working gas as long as the working gas is liquefied (See FIG. 2).

As described above, the pulse tube refrigerator of the present invention make it possible to hold a cooling temperature without adjusting the temperature by use of a heater and the like as in prior art. Therefore, it is not necessary to spend electric energy for the heater and the like, resulting in reduction of energy consumption. Moreover, no control mechanism of the heater simplifies an apparatus, so that the apparatus causes less frequent failures and reduces its cost. Furthermore, no wiring into the vacuum space requires no sealing work, thereby posing no risk of leakage. The cryopump of the present invention employs the above-mentioned pulse tube refrigerator, thus providing the excellent effects described above.

Examples of the working gas in the present invention include various single gases such as nitrogen gas, argon gas and the like. In addition, usable is the air and a gas mixture of helium gas and the like with the above-mentioned single gases. Where the range of the operating temperature of the pulse tube refrigerator is readily known, it is possible to select a single gas or a mixture-ratio-adjusted gas mixture, based on the liquefying temperature thereof which is within the aforementioned range.

BEST MODE FOR CARRYING OUT THE INVENTION

Figure 1:
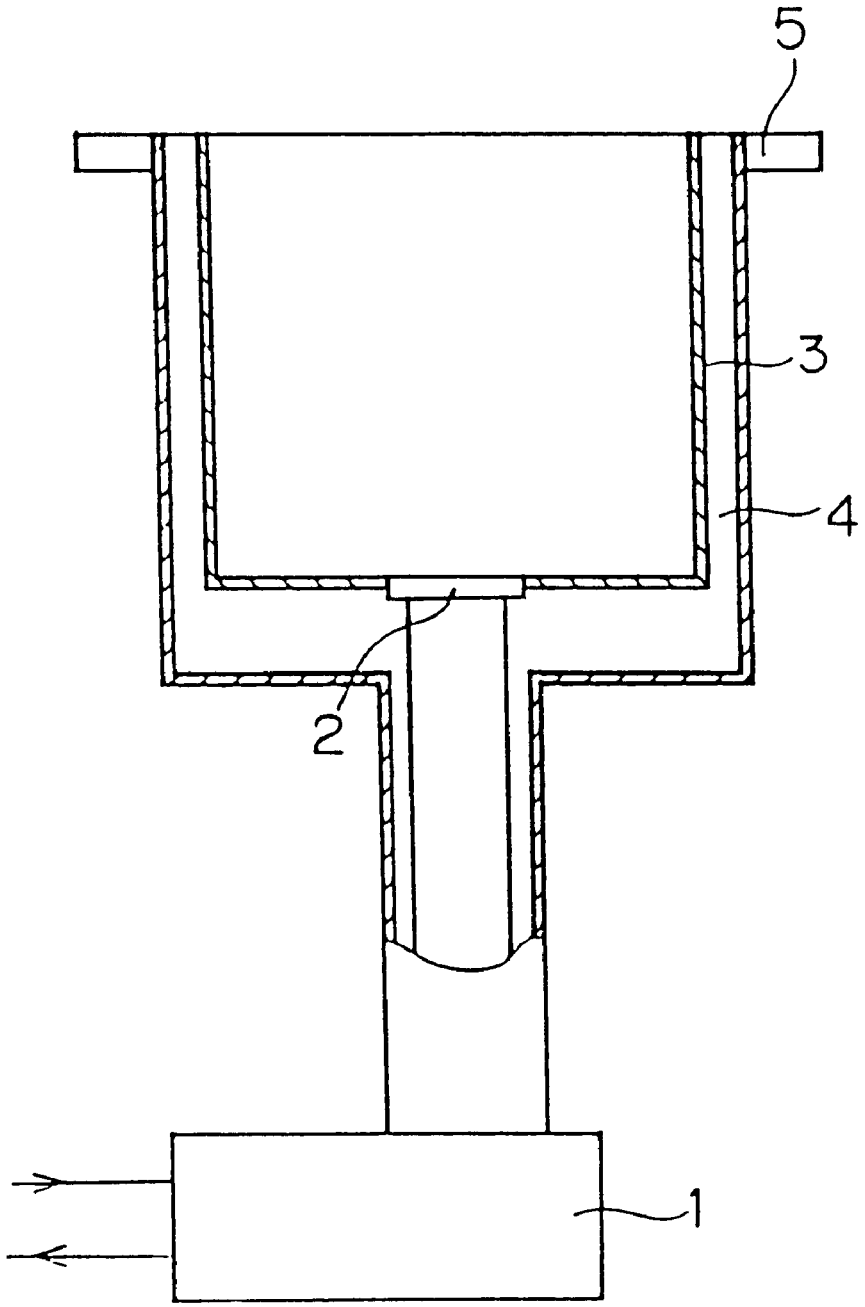
FIG. 1 is a cross-sectional view of a cryopump such as the present invention.

Embodiments of a cryopump of the present invention will next be described in detail. In the embodiments of the present invention, instead of a GM refrigerator, a pulse tube refrigerator 1 employing nitrogen gas (single gas) as a working gas was used. Coldhead 2 has no heater, no thermometer, and further no temperature controller. Therefore, there is no heater wiring. The embodiments were the same as in FIG. 1, except for the above-mentioned.

The embodiments of the present invention do not employ a heater and the like, offering a reduction in electric energy consumption, a lower frequency of failure and a lower cost of equipment. In addition, no heater wiring results in no risk of a vacuum leakage.

EXAMPLE 1

Figure 2:
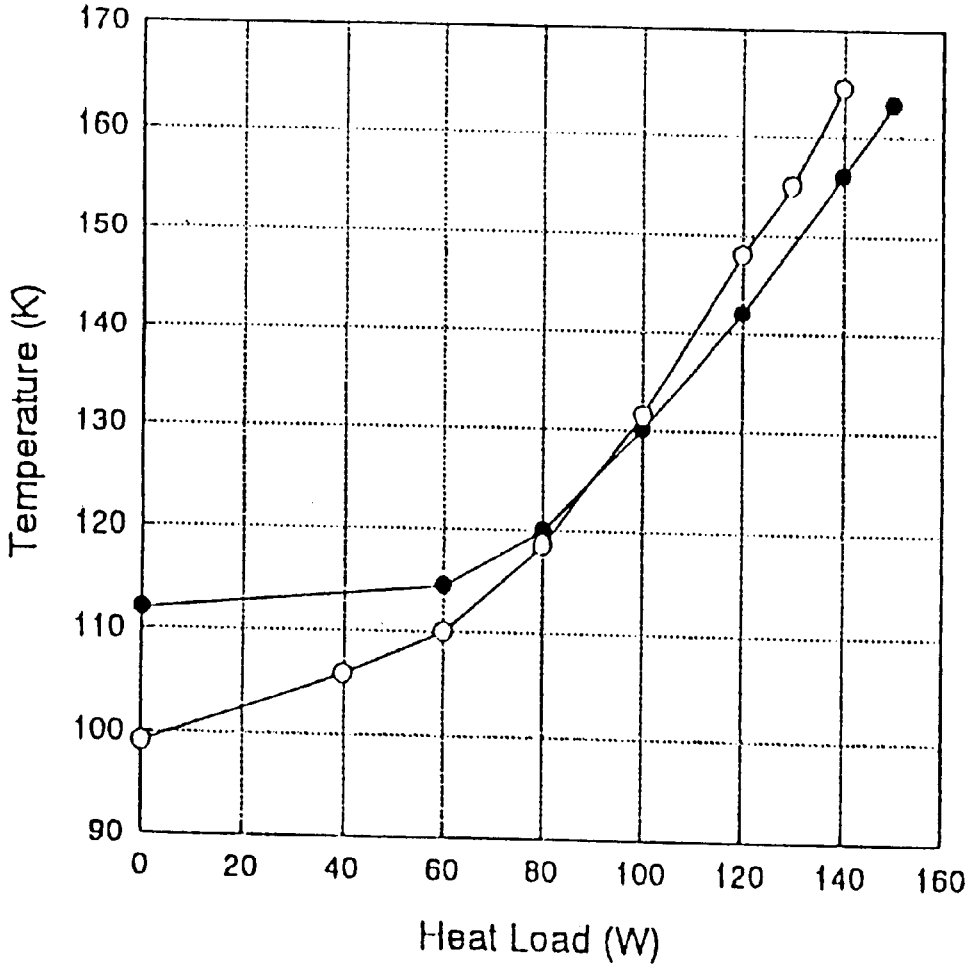
FIG. 2 is a graph illustrating the relation between the heat load to the coldhead and the temperature of the coldhead.

In the same cryopump as described above, nitrogen gas with an absolute pressure of 18.0 kgf/cm$^2$ was filled as a working gas. When the heat load, during the operation of the pulse tube refrigerator, was applied by the heater (experimental installation for application of heat load) installed on the coldhead, temperature changes of the coldhead were measured. The results are shown (illustrated by black spots) in FIG. 2, which explicitly shows that a temperature holding effect by liquefaction of the working gas was observed, and that a cooling temperature was held in the range of 112–115K with a heat load of 0–60 W. Then, nitrogen has a liquefying temperature of 112K with a pressure of 16.4 kgf/cm$^2$.

EXAMPLE 2

In the same cryopump as described above, a mixture of nitrogen gas and helium gas with a partial pressure of 14.4 kgf/cm$^2$ and 3.6 kgf/cm$^2$, respectively, was filled as a working gas. When heat load, during operation of the same pulse tube refrigerator as in Example 1, was applied by the heater (experimental installation for application of heat load) installed on the coldhead, temperature changes of the coldhead were measured. The results are shown (illustrated by white spots) in FIG. 2, which explicitly shows that a temperature holding effect by liquefaction of the working gas was observed, and that a cooling temperature was held in the range of 99–110K with a heat load of 0–60 W. Example 2 had the two components, nitrogen and helium, which created a vapor-liquid equilibrium, and thus reached to a lower temperature than Example 1. Then, nitrogen has a liquefying temperature of 110K with a pressure of 16.4 kgf/cm$^2$.

INDUSTRIAL APPLICABILITY

The pulse tube refrigerator of the present invention may be employed in a cryopump exclusive for water (for example, a cryopump manufactured by Helix Technology Corporation under the trade name of Waterpumps), various cryopumps, a cold trap and the like. Further, the cryopump of the present invention may be employed in various vacuum apparatus such as a vacuum apparatus for manufacturing of semiconductors and magneto-optic recording media and the like.

What is claimed is:

1. A pulse tube refrigerator employing a working gas which has a liquefying temperature within the range of an operating temperature of the pulse tube refrigerator.

2. A pulse tube refrigerator according to claim 1, wherein the working gas is a single gas or a mixture of gases.

3. A pulse tube refrigerator according to claim 1, wherein the working gas is nitrogen gas.

4. A cryopump employing the pulse tube refrigerator as recited in claim 1.

5. A cryopump according to claim 4, wherein a working gas of the pulse tube refrigerator is nitrogen gas or a mixture of gases including nitrogen gas.

* * * * *

UNITED STATES PATENT AND TRADEMARK OFFICE

CERTIFICATE OF CORRECTION

PATENT NO. : 6,293,109 B1
DATED : September 25, 2001
INVENTOR(S) : Miyamoto et al.

It is certified that error appears in the above-identified patent and that said Letters Patent is hereby corrected as shown below:

Title page,
Title, "PULSE PIPE REFRIGERATING MACHINE AND CRYOPUMP USING THE REFRIGERATING MACHINE" should be -- PULSE TUBE REFRIGERATOR AND CRYOPUMP USING THE SAME --

Column 1,
Line 47, "necessitating control the" should be -- necessitating the --
Line 57, "cyropump" should be -- cryopump --

Column 2,
Line 51, "make" should be -- makes --

Signed and Sealed this

Twenty-fifth Day of June, 2002

*Attest:*

*Attesting Officer*

JAMES E. ROGAN
*Director of the United States Patent and Trademark Office*